US008777272B2

(12) United States Patent
Welchert

(10) Patent No.: US 8,777,272 B2
(45) Date of Patent: Jul. 15, 2014

(54) WET/DRY VACUUM HOSE ATTACHMENT

(76) Inventor: Joseph Welchert, Scottsdale, AZ (US)

( * ) Notice: Subject to any disclaimer, the term of this patent is extended or adjusted under 35 U.S.C. 154(b) by 0 days.

(21) Appl. No.: 13/348,483

(22) Filed: Jan. 11, 2012

(65) Prior Publication Data

US 2012/0175868 A1 Jul. 12, 2012

Related U.S. Application Data

(60) Provisional application No. 61/431,648, filed on Jan. 11, 2011.

(51) Int. Cl.
*A47L 9/24* (2006.01)

(52) U.S. Cl.
USPC ..... 285/7

(58) Field of Classification Search
USPC ..... 285/7, 12; 15/414, 415.1
See application file for complete search history.

(56) References Cited

U.S. PATENT DOCUMENTS

| | | | | | |
|---|---|---|---|---|---|
| 1,752,664 | A | | 4/1930 | Forcier | |
| 3,408,091 | A | * | 10/1968 | Zylstra | 285/7 |
| 3,781,941 | A | * | 1/1974 | MacFarland | 285/7 |
| 4,053,962 | A | | 10/1977 | McDowell | |
| 4,114,230 | A | | 9/1978 | MacFarland | |
| 4,191,407 | A | * | 3/1980 | Bretone, Jr. | 285/56 |
| 4,318,547 | A | * | 3/1982 | Ericson | 285/3 |
| 4,476,607 | A | | 10/1984 | Ross | |
| 4,479,281 | A | | 10/1984 | Mikutowski | |
| 4,553,284 | A | * | 11/1985 | Strumbos | 15/415.1 |
| 4,714,279 | A | * | 12/1987 | Custeau | 285/239 |
| 4,763,932 | A | * | 8/1988 | Matz et al. | 285/903 |
| 5,042,844 | A | * | 8/1991 | Iida et al. | 285/7 |
| 5,050,266 | A | | 9/1991 | Schneider | |
| 5,054,160 | A | * | 10/1991 | Marino | 15/415.1 |
| RE34,325 | E | * | 7/1993 | Rau et al. | 285/7 |
| 5,452,493 | A | * | 9/1995 | Galindo | 15/414 |
| 5,598,867 | A | * | 2/1997 | Sullivan | 285/7 |
| 5,915,406 | A | * | 6/1999 | Traylor | 285/12 |
| 6,394,505 | B1 | * | 5/2002 | Schmucki et al. | 285/148.26 |
| 6,976,710 | B1 | * | 12/2005 | Bedford | 285/12 |
| 7,559,581 | B2 | * | 7/2009 | Saito et al. | 285/903 |
| 8,113,543 | B1 | * | 2/2012 | Romani et al. | 285/7 |
| 8,167,337 | B2 | * | 5/2012 | Bruno et al. | 285/7 |

* cited by examiner

*Primary Examiner* — David E Bochna
(74) *Attorney, Agent, or Firm* — Barbara J. Luther; The Luther Law Firm, PLC

(57) ABSTRACT

In one embodiment, a vacuum attachment for reaching smaller spaces has a gasket and narrow tubing. The gasket includes i. a cap member sized to fit over an open end of a vacuum hose, the cap member having an inner surface and a central hole to accommodate a narrow tube; ii. inner wall members extending from the central hole of the cap and gripping the narrow tube; and iii. outer wall members extending from the cap member perimeter to a distal edge and accommodating the vacuum hose, the wall members having an internal surface with ribs that extend from the distal edge of the wall members to and on the inner surface of the cap. The at least one narrow, bendable tube is fashioned to fit into the central hole of the cap member and has sufficiently thick walls to avoid collapse when a vacuum is applied thereto.

5 Claims, 4 Drawing Sheets

WET/DRY VACUUM HOSE ATTACHMENT

RELATED APPLICATIONS

This application claims the benefit of U.S. Provisional Patent Application No. 63/431,648, filed on Jan. 11, 2011.

FIELD OF THE INVENTION

This invention relates to vacuum cleaners, and more specifically, to an attachment for wet/dry vacuums which is flexible to allow for cleaning of narrow spaces.

BACKGROUND OF THE INVENTION

Vacuum cleaners that may be used to collect both wet and dry material, commonly referred to as wet/dry vacuums or wet/dry "vacs," are well known. Wet/dry vacs are often used in workshops and or other areas where both wet and dry debris may accumulate.

Wet/dry vacs generally consist of a collection tank or canister and a cover or lid upon which a motor and impeller assembly is mounted. The motor and impeller assembly creates suction within the canister, such that debris and liquid are drawn into the canister through an air inlet to which a hose may be attached. A filter within the canister prevents incoming debris from escaping from the canister while allowing filtered air to escape.

Different attachments may be connected to the hose to allow the wet/dry vacuum to clean different areas. In general, these attachments are formed or a rigid plastic material.

A need existed to provide a device and method to overcome the problems of existing devices.

SUMMARY OF THE INVENTION

In one embodiment, a vacuum attachment for reaching smaller spaces has a gasket and narrow tubing. The gasket includes i. a cap member sized to fit over an open end of a vacuum hose, the cap member having an inner surface and a central hole to accommodate a narrow tube; ii. inner wall members extending from the central hole of the cap and gripping the narrow tube; and iii. outer wall members extending from the cap member edge to a distal edge and accommodating the vacuum hose, the wall members having an internal surface with ribs that extend from the distal edge of the wall members to and on the inner surface of the cap. The at least one narrow, bendable tube is fashioned to fit into the central hole of the cap member and has sufficiently thick walls to avoid collapse when a vacuum is applied thereto.

The at least one narrow tube of claim 1 is thick-walled and flexible and made of vinyl or polyethylene. In another embodiment, the attachment has four narrow tubes, a first tube that fits inside the inner wall members and additional tubes that fit inside each other. The first tube is about two feet in length, and about 1.6 cm (⅝ inch) interior diameter; the second tube is about one foot in length and has a 1.3 cm (½ inch) interior diameter; the third tube has a length of about one foot and an interior diameter of about 0.95 cm (⅜ inch); and the fourth tube has a length of about one foot and an interior diameter of about 0.6 cm (¼ inch). The gasket is optionally made of thick rubber. Optionally, the gasket is provided in two outer wall diameters to accommodate vacuum hoses of about 3.2 cm (1¼ inch), 3.8 cm (1½ inch), 4.8 cm (1⅞ inch) and about 6.35 cm (2½ inch). Alternately, the gasket has a middle wall between the inner wall and the outer wall members, the middle wall stiffening the gasket for more convenient operation.

In another embodiment, a vacuum attachment for reaching smaller spaces has a gasket and narrow tubing. The gasket has i. a cap member sized to fit over an open end of a vacuum hose, the cap member having a top surface and a central hole to accommodate a narrow tube, the top surface having at least one hole to relieve pressure; ii. inner wall members extending from the central hole of the cap and gripping the narrow tube; and iii. outer wall members extending from the cap member edge and accommodating the vacuum hose. The at least one narrow, bendable tube is fashioned to fit into the central hole of the cap member and has sufficiently thick walls to avoid collapse when a vacuum is applied thereto.

The at least one narrow tube of claim 1 is thick-walled and flexible and made of vinyl or polyethylene. In another embodiment, the attachment has four narrow tubes, a first tube that fits inside the inner wall members and additional tubes that fit inside each other. The first tube is about two feet in length, and about 1.6 cm (⅝ inch) interior diameter; the second tube is about one foot in length and has a 1.3 cm (½ inch) interior diameter; the third tube has a length of about one foot and an interior diameter of about 0.95 cm (⅜ inch); and the fourth tube has a length of about one foot and an interior diameter of about 0.7 cm (¼ inch). The gasket is optionally made of thick rubber. Optionally, the gasket is provided in two outer wall diameters to accommodate vacuum hoses of about 3.2 cm (1¼ inch), 3.8 cm (1½ inch), 4.8 cm (1⅞ inch) and about 6.35 cm (2½ inch). Alternately, the gasket has a middle wall between the inner wall and the outer wall members, the middle wall stiffening the gasket for more convenient operation.

BRIEF DESCRIPTION OF THE DRAWINGS

Common reference numerals are used throughout the drawings and detailed description to indicate like elements.

DETAILED DESCRIPTION

Figure 1:
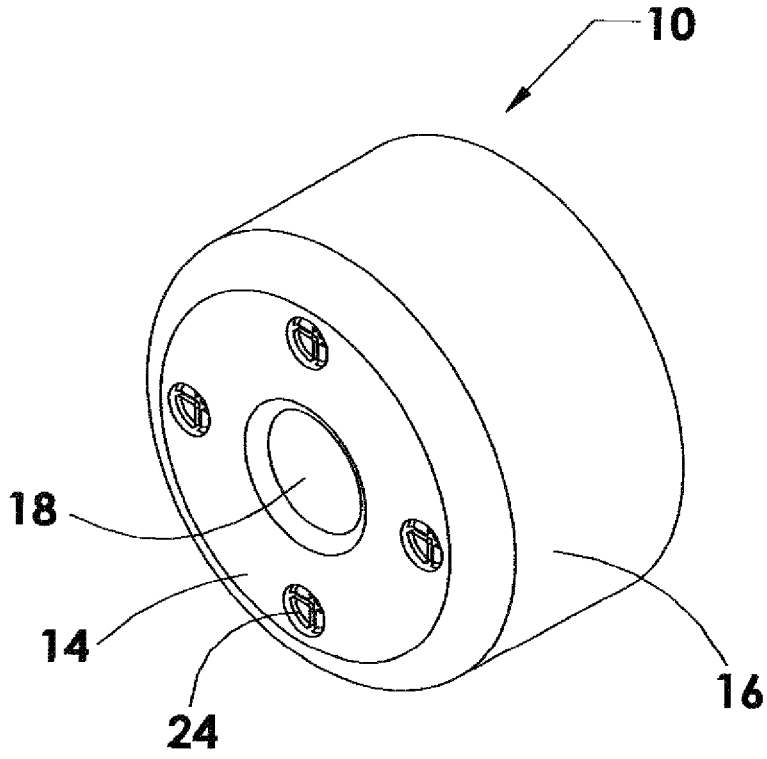
FIG. 1 is a perspective view of one embodiment of the present invention.

I have found that the prior art vacuum attachments did not conveniently perform the jobs I needed done. The different available attachments are made out of rigid materials that have limitations. First, since current attachments are not flexible, current wet/dry vacuums cannot be used to clean in narrow openings, curved areas, P-traps to remove blockages, and the like. Further, current attachments do not allow for one to connect the hose to copper tubing, valves, and the like in order to drain fluids from different devices.

My new attachment provides several advantages. First, the attachment comprises a gasket and at least one narrow tubing.

The gasket is a soft but firm material to stretch to the hose size. Second, the attachment enables the use of small diameter tubing, which allows for cleaning in narrow openings, curved areas, and the like. Third, another embodiment has internal ridges to offset the vacuum hose and permit breathability (less build up of pressure). Fourth, tubing slides into the rubber gasket, a configuration that diminishes trapping of collected materials. Fifth, the included tubing has relatively thick walls to avoid the collapse seen when a vacuum force is applied to weaker wall tubing. The attachment further allows a wet/dry vacuum to be attached to piping, gate valves, and the like for draining of fluids from different apparatuses. The attachment also allows for the wet/dry vacuum to be attached to inflatable items like air mattresses and the like in order to inflate and or deflate the aforementioned. The attachment further allows for the wet/dry vacuum to be used in P-traps to remove blockages and the like. The above advantages of the attachment are not all-inclusive and should not be seen in a limiting manner.

Referring now to the figures, a wet/dry vacuum attachment gasket 10 is shown. The gasket 10 is connected to an existing hose on a wet/dry vacuum (not shown). The attachment 10 is comprised of a cap member 14. The cap member 14 is sized to fit over an open end of the existing hose 1 of a wet/dry vacuum. The cap member 14 has a top surface (where the numeral 14 appears). In the present embodiment, the cap member 14 is circular in nature. However, the shape of the cap member 14 is not limiting manner.

Outer wall members 16 extend (distally) away from the cap member 14. The wall members 16 extend away from an outer perimeter of the cap member 14. In accordance with one embodiment of the present invention, the wall members 16 extend approximately 3.8 centimeters (cm) (1.5 inches) from the cap member 14. The wall members 16 are used to firmly secure the gasket 10 to the open end of the hose 1 of the dry/wet vacuum.

An opening 18 is formed in a central area of the cap member 14. The opening 18 is sized to accommodate a flexible tubing 20. In order to secure the flexible tubing 20, inner wall members 22 extend away from the perimeter of the opening 18. The inner wall members 22 extend approximately 3.8 cm (1.5 inches) from the opening 18 in the cap member 14. In operation, the flexible tubing 20 is inserted into the opening 18 down a channel formed by the inner wall members 22. This secures the flexible tubing 20 within the cap member 14. Also included in the attachment kit is at least one additional narrower tube (not shown) that can be inserted inside the flexible tubing 20. To vacuum even smaller spaces, one or more additional narrower tubes can be inserted into the preceding narrower tube(s).

In one embodiment, one or more pressure openings 24 are formed in the cap member 14. The pressure openings 24 may be slits or the like formed through the cap member 14. The pressure openings 24 may be used to ensure that excessive pressure does not build up within a motor (not shown) of the wet/dry vacuum.

Figure 2:
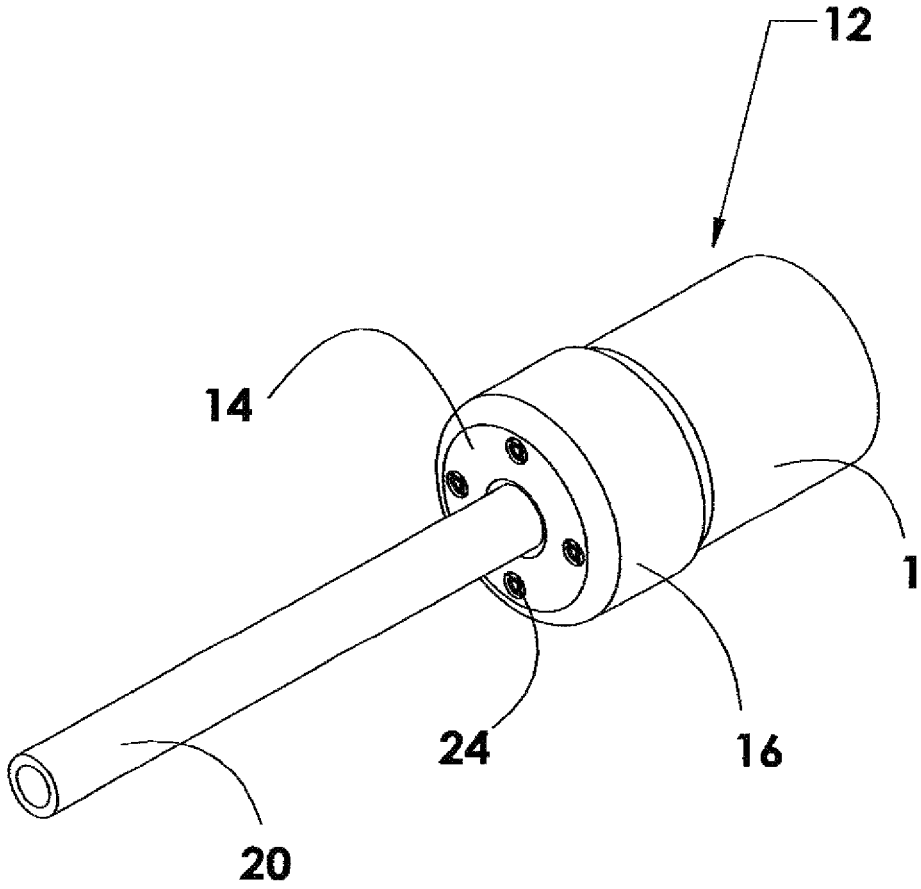
FIG. 2 is a perspective view of the embodiment of FIG. 1 with the flexible tube attached.
Figure 4:
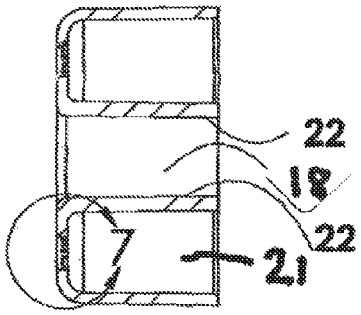
FIG. 4 is a cross-sectional view taken along lines 4-4 of Figure.
Figure 3:
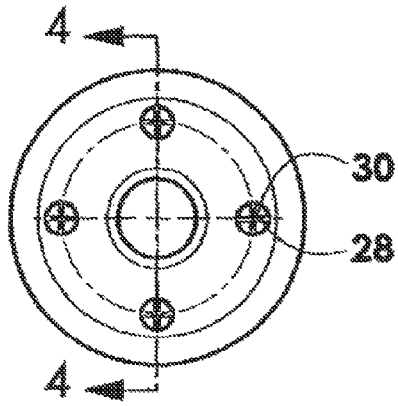
FIG. 3 is a front view of the embodiment of FIG. 1.
Figure 5:
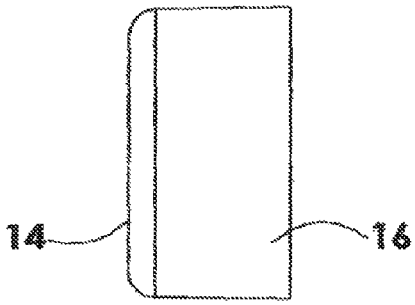
FIG. 5 is a side view of the embodiment of FIG. 1.
Figure 6:
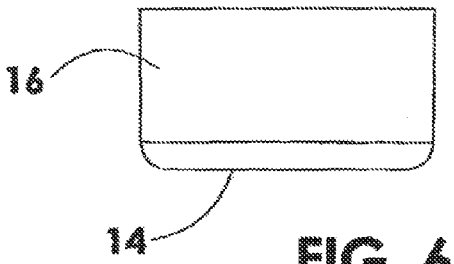
FIG. 6 is a rotated side view of the embodiment of FIG. 1.
Figure 7:
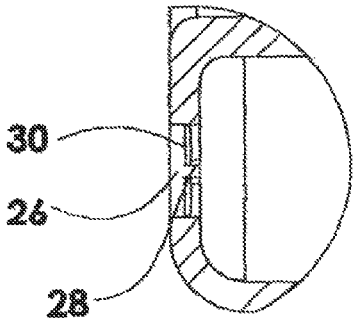
FIG. 7 is a magnified view of a portion of the present invention as shown in FIG. 4.
Figure 8:
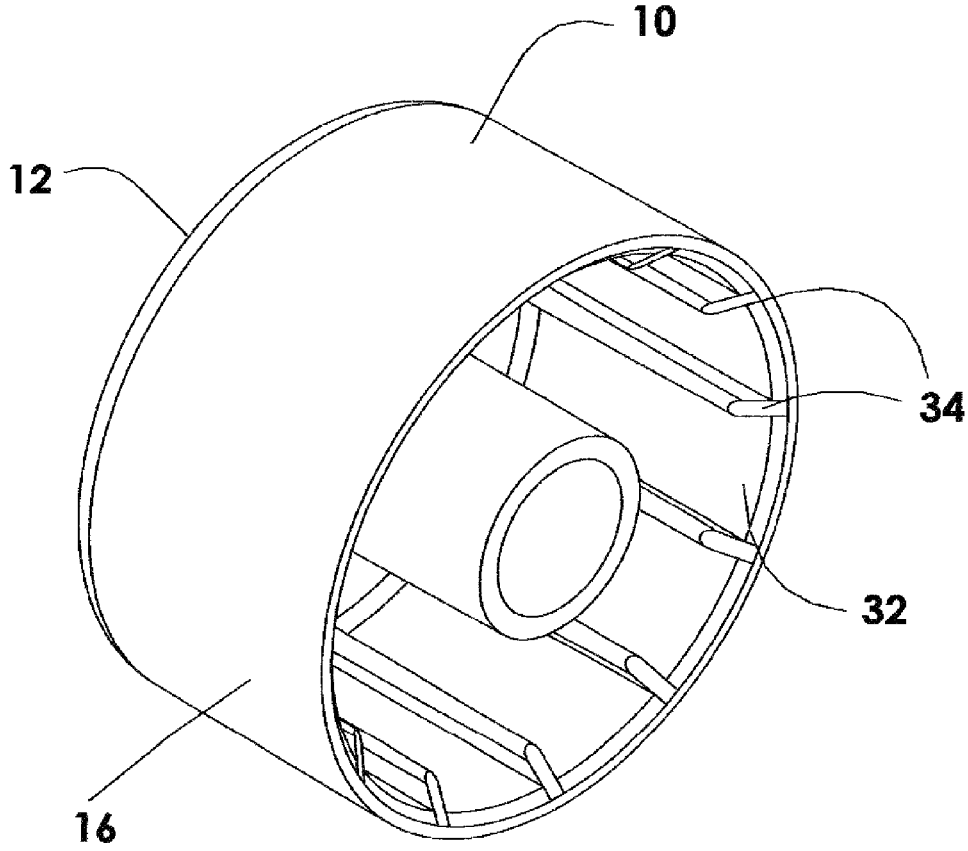
FIG. 8 is a perspective view of another embodiment with internal ribs in the outer wall to offset the vacuum hose and reduce unwanted pressure build up.

In the embodiment shown in FIGS. 1-4, the pressure openings 24 are formed of a circular layer 26 removed from the top surface of the cap member 14. A pair of slits 28 is formed in the area below where the circular layer 26 was removed. The slits 28 form a "+" pattern but this should not be seen in a limiting fashion. The slits 28 form flap members 30. As pressure may build up with the wet/dry vacuum due to blockage or slow flow through the narrow flexible tubing(s) 20 and or hose 1, the flap members 30 bend inward to allow more air to flow through the cap member 14, thereby relieving pressure build-up and preventing damage to the motor of the wet/dry vacuum. In a similar manner, if the wet/dry vacuum is being used to blow air out of the hose 1 such as when the flex tubing 20 is attached to an inflatable item, the flap members 30 may bend outward to allow more air to flow out through the cap member 14, thereby relieving pressure build-up and preventing damage to the motor of the wet/dry vacuum.

In a preferred embodiment, pressure build-up is handled in another way. Rather than slits 28 with flaps 30, as disclosed above, the gasket 10 has outer wall members 16 whose inner side 32 has ribs 34 that extend the length of the walls and onto the inner surface of the cap member 14. The ribs 34 serve to both grip variable sizes of the vacuum hose 1 and to maintain a space between the vacuum hose and the inner surface of the outer walls 16. This space permits some air to pass so that pressure does not build up and harm the vacuum engine. This configuration directs the air away from the operator for safer operation.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

The invention claimed is:

1. A vacuum attachment for reaching smaller spaces, the attachment comprising a. a gasket comprising
   i. a cap member sized to fit over an open end of a vacuum hose, the cap member having an inner surface and a central hole to accommodate a narrow tube;
   ii. an inner wall extending from the central hole of the cap and gripping the narrow tube; and
   iii. an outer wall extending from the cap member to a distal edge and accommodating the vacuum hose, the wall having an internal surface with ribs that extend from the distal edge of the wall to and on the inner surface of the cap; and b. at least one narrow, bendable tube fashioned to fit into the central hole of the cap member and having sufficiently thick walls to avoid collapse when a vacuum is applied thereto.

2. The vacuum attachment of claim 1, wherein the at least one narrow tube is thick-walled and flexible and comprises vinyl or polyethylene.

3. The vacuum attachment of claim 1, wherein the gasket comprises thick rubber.

4. The vacuum attachment of claim 1, wherein the gasket is provided in two outer wall diameters to accommodate vacuum hoses of about 3.2 cm (1¼ inch), 3.8 cm (1½ inch), 4.8 cm (1⅞ inch) and about 6.35 cm (2½ inch).

5. The vacuum attachment of claim 1, wherein the gasket further comprises a middle wall between the inner wall and the outer wall, the middle wall stiffening the gasket for more convenient operation.

* * * * *